US007685980B2

(12) United States Patent
Lee et al.

(10) Patent No.: US 7,685,980 B2
(45) Date of Patent: Mar. 30, 2010

(54) SYSTEM FOR SELECTIVELY VARYING ENGINE VALVE OPEN DURATION

(75) Inventors: Jongmin Lee, Pittsford, NY (US); Jeffrey D. Rohe, Caledonia, NY (US); Edward S. Suh, Rochester, NY (US); Michael B. Knauf, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 168 days.

(21) Appl. No.: 11/904,851

(22) Filed: Sep. 28, 2007

(65) Prior Publication Data

US 2008/0078346 A1 Apr. 3, 2008

Related U.S. Application Data

(60) Provisional application No. 60/847,784, filed on Sep. 28, 2006.

(51) Int. Cl.
*F01L 1/34* (2006.01)

(52) U.S. Cl. ..... 123/90.16; 123/90.15; 123/90.39

(58) Field of Classification Search ..... 123/90.15, 123/90.16, 90.39

See application file for complete search history.

(56) References Cited

U.S. PATENT DOCUMENTS

| | | | | |
|---|---|---|---|---|
| 4,476,822 | A | 10/1984 | Bonvallet | |
| 6,189,497 | B1 | 2/2001 | Griffiths | |
| 6,659,053 | B1 | 12/2003 | Cecur | |
| 6,679,207 | B1 * | 1/2004 | Leman | 123/90.16 |
| 2004/0020454 | A1 * | 2/2004 | Koro et al. | 123/90.16 |
| 2005/0087159 | A1 | 4/2005 | Harmon | |

* cited by examiner

*Primary Examiner*—Zelalem Eshete
(74) *Attorney, Agent, or Firm*—Thomas N. Twomey

(57) ABSTRACT

A continuously variable valve duration system including a rocker assembly acted upon by two off-spaced camshafts for selectively varying the closing point of a valve in an internal combustion engine. An opening camshaft is rotatably driven by the engine crankshaft and controls at least the opening and point of the valve through a rocker assembly disposed on a fixed pivot shaft. A closing camshaft, rotatably connected to the opening intake camshaft through a cam phaser, is poised to take over control of the valve closing event through the same rocker assembly. By changing the rotational phase of the closing camshaft relative to the opening camshaft via the cam phaser, the valve closing event can be either retarded or advanced so as to override the opening camshaft and thus selectively vary the valve event duration.

18 Claims, 8 Drawing Sheets

SYSTEM FOR SELECTIVELY VARYING ENGINE VALVE OPEN DURATION

RELATIONSHIP TO OTHER APPLICATIONS AND PATENTS

This patent application claims the benefit of U.S. Provisional Application No. 60/847,784, filed Sep. 28, 2006.

STATEMENT REGARDING FEDERALLY SPONSORED RESEARCH OR DEVELOPMENT

The present invention was supported in part by U.S. Government Contract No. DE-FC26-05NT42483. The United States Government may have rights in the present invention.

TECHNICAL FIELD

The present invention relates to valvetrains of internal combustion engines; more particularly, to devices for controlling the open duration of valves in such valvetrains; and most particularly, to a system for selectively varying the point at which the intake valves close in an internal combustion engine.

BACKGROUND OF THE INVENTION

Many advances have been made recently toward reducing the emissions and increasing the efficiency of Diesel engines. One such advancement has been the development of Homogeneous Charge Compression Ignition (HCCI) systems. HCCI is a process wherein an initial premixed, homogeneous charge of Diesel fuel and air is compressed and partially burned by high temperature and pressure in a flameless process, followed by one or more post injections of fuel, as opposed to classic Diesel ignition wherein a charge of air is compressed and then injected with Diesel fuel, resulting a stratified mixture of fuel and air. HCCI has yielded many benefits including extremely low emissions of $NO_x$ and particulate matter (soot) because of lower ignition temperatures and the use of a leaner fuel/air mixture.

However, HCCI has its challenges. For example, with a compression ratio in the range of 9:1 to 14:1, starting an HCCI-ignited engine in cold weather can be difficult. This challenge can be addressed by selectively varying the point at which the intake valves close during the engine cycle to controllably reduce the compression ratio from that of a higher designed value, optimized for cruising conditions. By selectively keeping the intake valve open for a portion of the compression stroke, a portion of the volume of air that would otherwise be compressed in the cylinder by the up-moving piston, is instead bled back through the open intake valve, thereby effectively reducing the compression ratio on the engine.

Mechanization of an HCCI strategy that can selectively vary the compression ratio has been proposed in the past with limited success because of system and hardware complexity. For example, mechanization has been achieved by using two separate cam phasers to operate two intake valves at each cylinder so that intake valve opening and intake valve closing can be controlled by the phasers independently. Although effective, the use of two cam phasers is costly, adds weight to an engine and vehicle and often cannot be fitted into available space.

What is needed in the art is a simplified mechanism for selectively varying the closing point of the intake valves of an HCCI engine that is relatively easy to manufacture and assemble, has few parts, and requires minimal packaging space in an engine envelope.

It is a principal object of the present invention to provide variable closing timing of intake valves of an internal combustion engine.

It is a further object of the invention to simplify the manufacture and assembly of a system for such variable closing timing.

SUMMARY OF THE INVENTION

Briefly described, a Continuously Variable Valve Duration (CVVD) system in accordance with the invention includes a rocker assembly acted upon by first and second cam lobes disposed on first and second off-spaced intake camshafts, respectively, for selectively varying the closing point of the poppet valves, for example, the intake valves, in an internal combustion engine. As disclosed below, the present invention is described in terms of the engine intake valves, but it should be understood that the invention is also applicable to engine exhaust valves as well, or to both intake and exhaust valves as may be desired.

The opening camshaft is rotatably driven by the engine crankshaft and controls conventionally the opening point of the valves through a novel rotatable rocker assembly disposed on a fixed rocker pivot shaft.

The closing camshaft is rotatable and is connected to the engine crankshaft through a cam phaser device driven preferably by a gear train from the opening camshaft. The closing cam lobe is poised to take over control of the closing event of the valves through the same rotatable rocker assembly. By changing the rotational phase of the closing camshaft relative to the opening camshaft via the cam phaser, the phase of the closing camshaft can be advanced or retarded relative to the opening camshaft to take over the closing event of the valves. By doing so, the point at which the valves close in the cycle can be selectively varied over a wide range of open times. Additional embodiments for adapting the CVVD system to various valvetrain types are provided.

An important advantage of the present device is its simplicity. With the rocker assembly being rotationally mounted on a fixed rocker shaft and the need for only one cam phaser to variably control the open duration time of the valves, the present invention accrues significant manufacturing, mechanical, and cost advantages over prior art arrangements.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently-preferred embodiments of the invention, and such exemplifications are not to be construed as limiting the scope of the invention in any manner.

DESCRIPTION OF THE PREFERRED EMBODIMENTS

Figure 1:
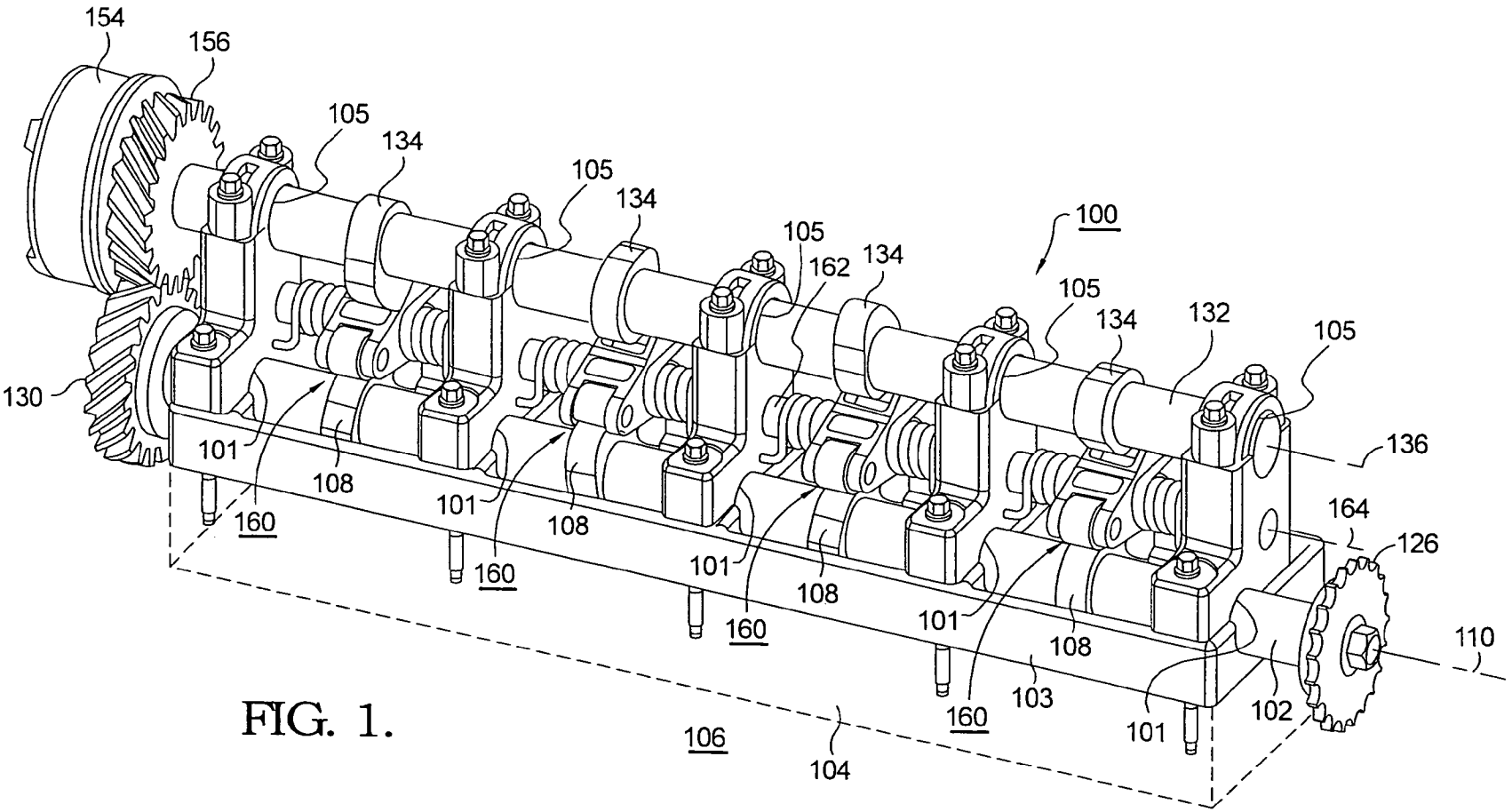
FIGS. 1 and 1*a* are isometric and exploded isometric views, respectively, of a first embodiment of a CVVD system in accordance with the invention, shown in an assembly for operating a set of intake or exhaust valves in a four-cylinder engine head.
Figure 1A:
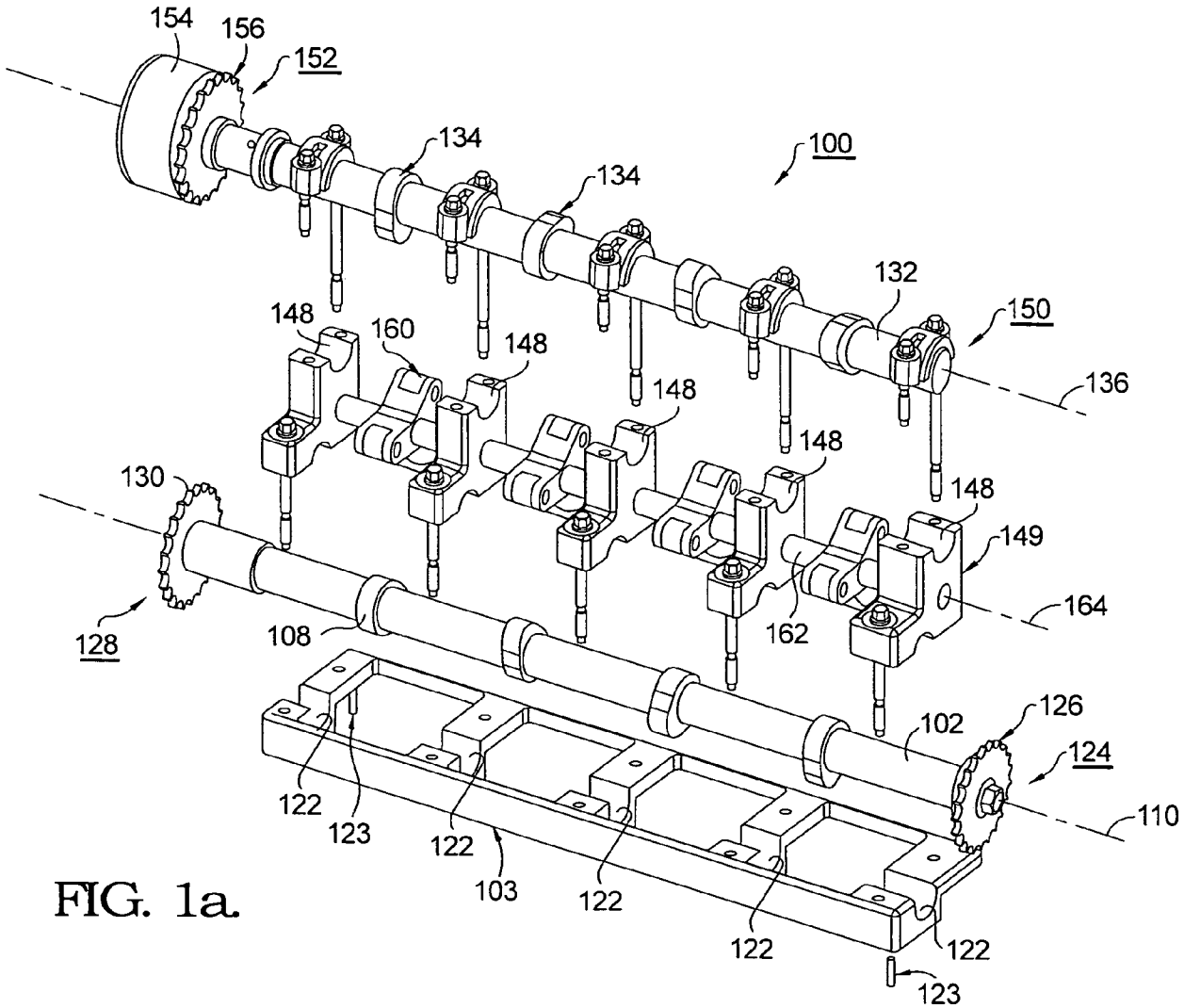

Referring to FIGS. 1, 1*a*, 2, and 2*a*, a CVVD system 100, in accordance with the invention, includes opening intake camshaft 102 mounted in base plate 103 for attachment to a cylinder head 104 of internal combustion engine 106. In the exemplary arrangement, engine 106 is a straight line 4-cylinder engine.

Opening intake camshaft 102 includes a plurality of cam lobes 108 equal in number to the number of engine cylinders and spaced along the longitudinal axis 110 of the camshaft. Each cam lobe 108 is defined by a profile having a base circle portion 112, an ascending flank 114, a nose portion 116, and a descending flank 118. Journals 101 (in this case five) are also spaced along the longitudinal axis of opening intake camshaft 102 and rest on mating bearing surfaces 122 of base plate 103. Dowels 123 are provided to align base plate 103 with head 104. First end 124 of opening intake camshaft 102 further includes gear 126 fixed to its end. Gear 126 is rotatably coupled to the engine crankshaft (not shown) through a belt, chain, or gear mesh and is sized to rotate the opening camshaft a single revolution for every two revolutions of the crankshaft, as is known in the art. Second end 128 of opening intake camshaft further includes output gear 130 fixed to its end. Both gears 126, 130 are secured to ends 124, 128 to rotate with opening intake camshaft 102. While gear 130 is shown as a spur gear (FIG. 1*a*), it is understood that it could be, for example, a helical gear (FIG. 1), as well.

CVVD system 100 further includes closing intake camshaft 132 off-spaced from and parallel to opening intake camshaft 102. Closing intake camshaft 132 further includes a plurality of cam lobes 134 equal in number to the number of engine cylinders and spaced along the longitudinal axis 136 of the camshaft. Each cam lobe 134 is defined by a profile having a base circle portion 138, an ascending flank 140, a nose portion 142, and a descending flank 144. Journals 105 are also spaced along the longitudinal axis 136 of closing intake camshaft 132 and rest on mating bearing surfaces 148 of carrier modules 149. First end 150 of closing intake camshaft 132 terminates at the first bearing surface 148 in the row of bearing surfaces. Second end 152 of closing intake camshaft 132 further includes a cam phaser 154 having input gear 156 in meshing engagement with output gear 130 of opening intake camshaft 102.

The geared relationship between the opening camshaft and the phaser of the closing camshaft is only exemplary. Obviously, the phaser may be driven directly by the engine crankshaft in a manner similar to that just described for the opening camshaft, or by any other suitable means, for example, by an electric motor, to perform the same valve-closing phasing function.

Cam phaser 154 may be of a variety of types of phasers known in the art including a type known in the prior art as a "vaned" cam phaser. As such the phaser is used to selectively alter the phase angle between cam lobes 108, 134 of the opening intake camshaft and closing intake camshaft, respectively.

CVVD system 100 further includes a plurality of rocker subassemblies 160, equal in number to the number of cylinders in head 104, and pivotably mounted on elongate rocker pivot shaft 162. Axis 164 of rocker pivot shaft 162 is off-spaced from, but parallel to, and disposed between opening intake camshaft 102 and closing intake camshaft 132. The position of rocker pivot shaft 162 relative to head 104 is fixed. That is, unlike prior art variable valve actuating systems, the pivot point (axis 164) of rocker assembly 160 is not moved in order to achieve the desired variation in valve actuation.

Rocker subassembly 160 further includes rocker lever 165 having opening input arm 166, closing input arm 168 and output arm 170. Roller 172 is rotatably fastened to an end of opening input arm 166 for engagement with an associated opening intake camshaft lobe 108. Roller 174 is rotatably fastened to an end of closing input arm 168 for engagement with associated closing intake camshaft lobe 134. Rollers 172, 174 are preferably formed of hardened steel as is known in the art.

At a distal end of output arm 170 is actuating paddle 176. Paddle 176 is preferably formed into a compound arcuate shape. Preferably each paddle contact surface 178 is ground for smooth contact with center roller 180 of each roller finger follower 182. Roller finger follower 182, as is well known in the art, pivots at first end 184 about hydraulic lash adjuster 186 as a downward force is applied to center roller 180 of roller finger follower 182 to open intake valve 188 against valve return spring 190. As can be readily seen in FIG. 2, rotation of rocker subassembly 160 in a clockwise direction about rocker pivot shaft 162 causes paddle 176 to be shifted leftward relative to center roller 180 of roller finger follower 182. Because of the progressively increasing radius 191*a*, 191*b* of contact surface 178 as measured from axis 164, as rocker subassembly assembly 160 rotates clockwise from the closed valve position shown in FIG. 2, valve 188 moves axially from its closed position (shown) to a full open position (not shown). It can also be readily seen that rotation of opening intake cam lobe 108 in clockwise direction 189 causes paddle 176 to shift leftward first, then back to control the movement of valve 188. Likewise, rotation of closing intake cam lobe 134 in counterclockwise direction 193 causes paddle 176 to shift leftward first, then back to control the movement of valve 188.

Torsional return spring 194 is connected at end 194*a* to rocker lever 165 and at end 194*b* to carrier module 149 to thereby bias rocker lever 165 in a counterclockwise direction so as to maintain contact between rollers 172, 174 and one or both of cam lobes 108, 134 during operation of the engine. While return spring 194 is shown as a torsional spring in FIG. 2, it is understood that the return spring may alternately be any type spring such as, for example, a compression coil spring or leaf spring disposed between lever 165 and module 149 for the same purpose.

As mentioned previously, gear 126 of opening intake camshaft 102 is driven by a chain, belt or gearing from an engine's crankshaft in a 2:1 rotational ratio (2 revolutions of the crankshaft for every one revolution of the camshaft 102). Since output gear 130 of opening intake camshaft 102 and input gear 156 of cam phaser 154 are of the same diameter and have the same number of teeth, closing intake camshaft 132 is driven from opening intake camshaft 102 in a 1:1 rotational ratio. And, since gears 126, 130 are in direct mesh, closing intake camshaft 132 rotates in a counter direction 193 from the direction 189 of opening intake camshaft 102. Recalling that opening intake camshaft 102 is rotationally connected to closing intake camshaft 132 through cam phaser 154, a signal received by the cam phaser from a controller (not shown) causes the angular position of lobe 134 of the closing intake camshaft to shift relative to lobe 108 of the opening camshaft, from its default position shown in FIG. 2 (reference line 196), to a more retarded position (reference line 197). This shift results in a delay of the closing point of the intake valve as will now be described.

Figure 2:
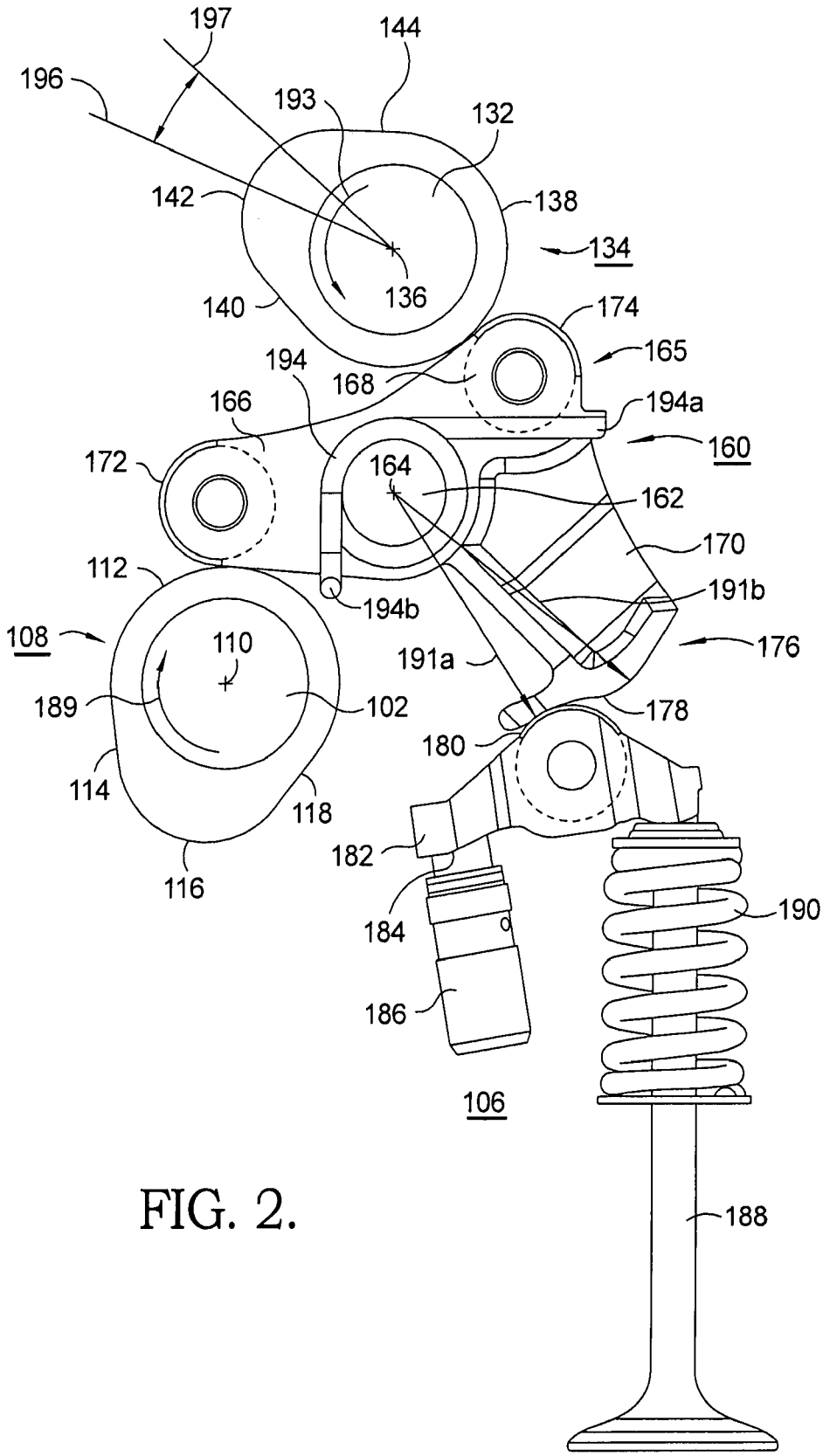
FIGS. 2 and 2*a* are end elevation and isometric views, respectively, of the first embodiment shown in FIGS. 1 and 1*a*, showing two intake valve camshafts and lobes operative on a first rocker assembly for a pair of combustion valves.
Figure 2A:
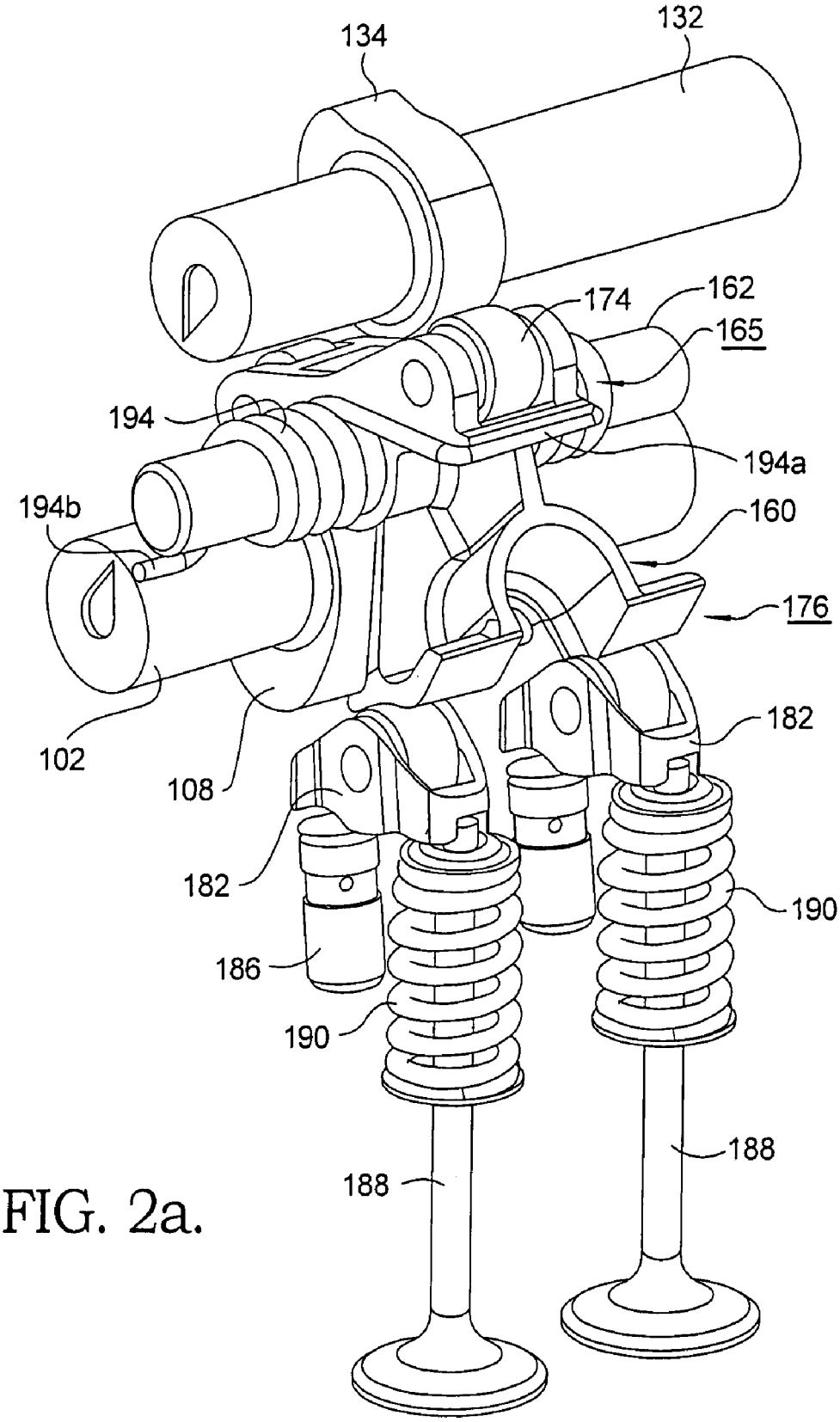
Figure 3:
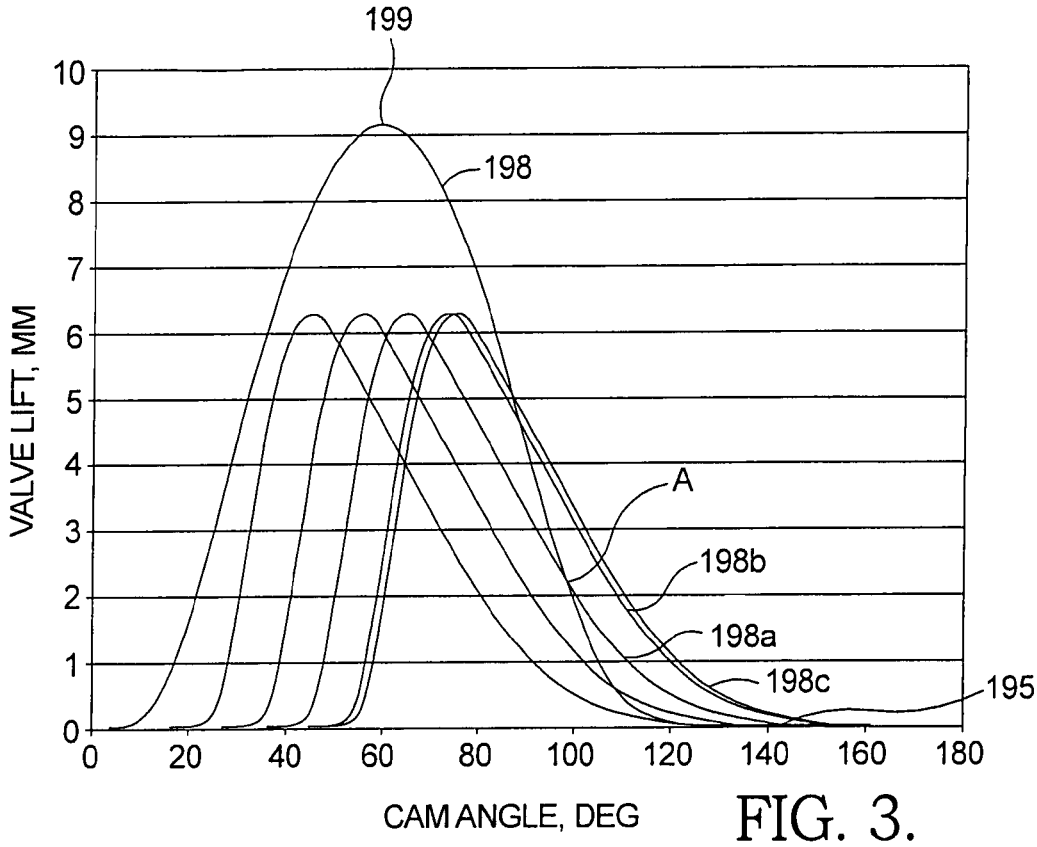
FIG. 3 is a graph showing a family of lift curves for a valvetrain equipped with a CVVD system in accordance with the invention, showing the degree to which the point of intake valve closing can be changed by the system.

Referring now to FIGS. 2 and 3, curve 198 represents an exemplary intake valve opening, lift, and closing characteristic profile of CVVD system 100 when the cam phaser is in its default position. That is, the entire valve event is controlled by lobe 108 of the opening intake camshaft contacting roller 172. During that event, while lobe 134 of the closing intake camshaft rotates from the meshing of gears, its phasing relative to the rotation of lobe 108 does not permit its ascending flank 140, nose portion 142, or descending flank 144 to contact roller 174. That is, as lobe 134 rotates as if to make contact with roller 174 by its ascending flank, roller 172 has already made contact with and started up the ascending flank of lobe 108. As lobe 134 continues its rotation as if to make contact with roller 174 by its nose portion 142, roller 172 has already made contact with and started across the nose portion of lobe 108. Finally, as lobe 134 continues its rotation as if to make contact with roller 174 by its descending flank 144, roller 172 has already started down the descending flank 118 of lobe 108. Thus, in the default mode of the phaser, lobe 108 of opening intake camshaft 102 remains in full control of rocker subassembly 160 to open and to close valve 188 in a normal lift profile as though closing lobe 134 did not exist.

Following curve 198 in FIG. 3, as roller 172 moves up the ascending flank 114 of the lobe 108, intake valve 188 opens. When the contact point moves through the nose portion 116 of lobe 108, valve 188 reaches its full open lift 199 of, typically, about 9 mm. Then as roller 172 moves down descending flank 118, it remains in contact with lobe 108 until the valve closes at about 120 cam angle degrees.

When delaying of the closing event of intake valve 188 is desired, a signal from the engine controller directs cam phaser 154 to retard the rotational position of closing intake camshaft 132 relative to opening intake camshaft 102. This causes a portion of descending flank 144 of closing intake cam lobe 134 to come into contact with roller 174 and to take over control of the movement of rocker sub assembly 160 from opening intake cam lobe 108. As can be seen by resulting curve 198, roller 172 remains in contact with lobe 108 almost through the entire opening and closing event. However, since the phasing of closing intake camshaft 132 has been retarded by the cam phaser, roller 174 comes in contact with descending flank 144 of lobe 134 at Point A (phaser retards lobe 134 by 20°) and, from that point until valve 188 is closed (curve 198*a*), closing intake cam lobe 134 takes over from opening intake cam lobe 108 and keeps intake valve 188 open to about 140 cam angle degrees (point 195 in FIG. 3). Curves 198*b* and 198*c* show additional amounts that intake valve 188 can be kept open, in cam angle degrees, by retarding the relative rotational position of closing intake camshaft 132 even further.

Figure 4:
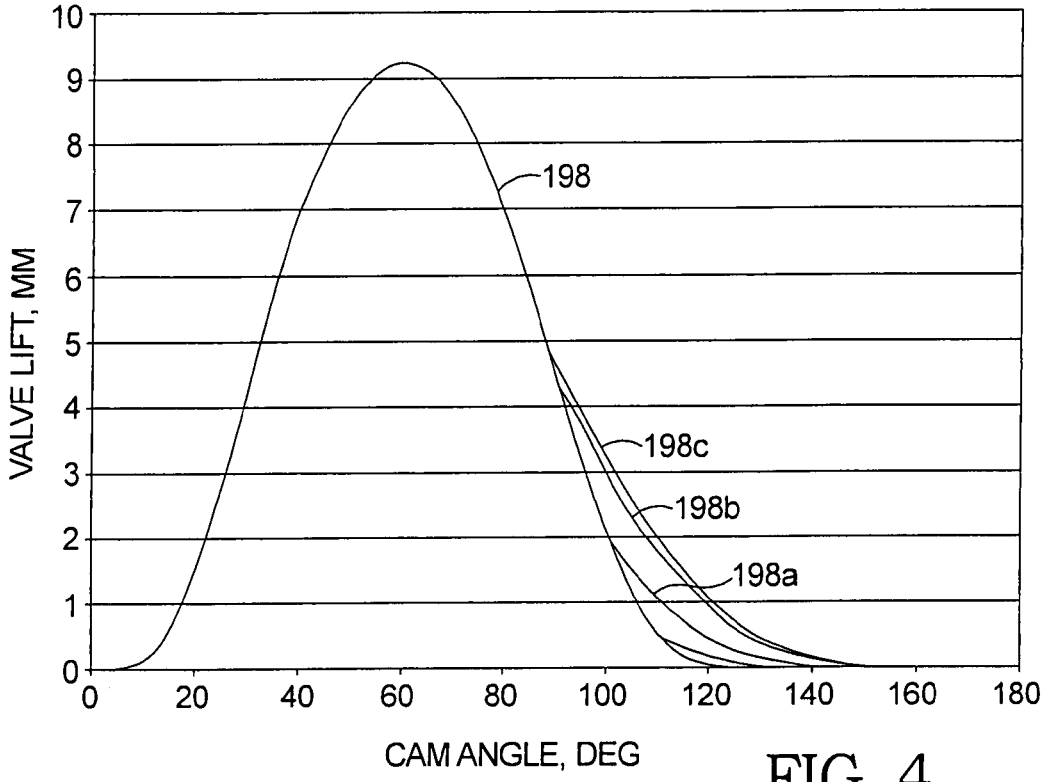
FIG. 4 is a graph of a composite lift curve taken from FIG. 3, showing the transition point at which the second intake valve camshaft takes over control of the lift event to effect a later valve closing point.

For clarity of presentation, FIG. 4 shows parent curve 198 and composite curves 198*a*, 198*b*, 198*c* derived from FIG. 3, again showing the increased duration of valve opening.

Referring again to FIG. 3, in the most retarded mode of closing intake camshaft 132 (composite curve 198*c*), the transition point when closing intake cam lobe 134 takes over occurs at a point when the valve is at a lift of approximately 5 mm, and rocker subassembly 160, roller finger follower 182, valve 188 and spring 190 are moving together in the closing direction at a relatively high velocity. At that point, closing intake cam lobe 134 and roller 174 come together, in an attempt to catch the moving mechanism to slow it down in order to extend valve duration.

Figure 5:
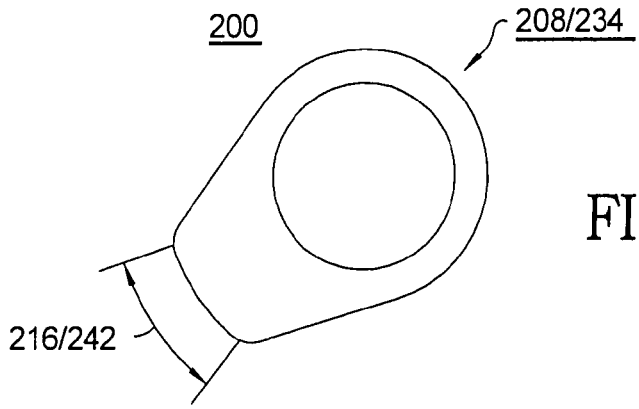
FIG. 5 is an end elevation view of a second embodiment of a second embodiment of a cam lobe in accordance with the invention.
Figure 6:
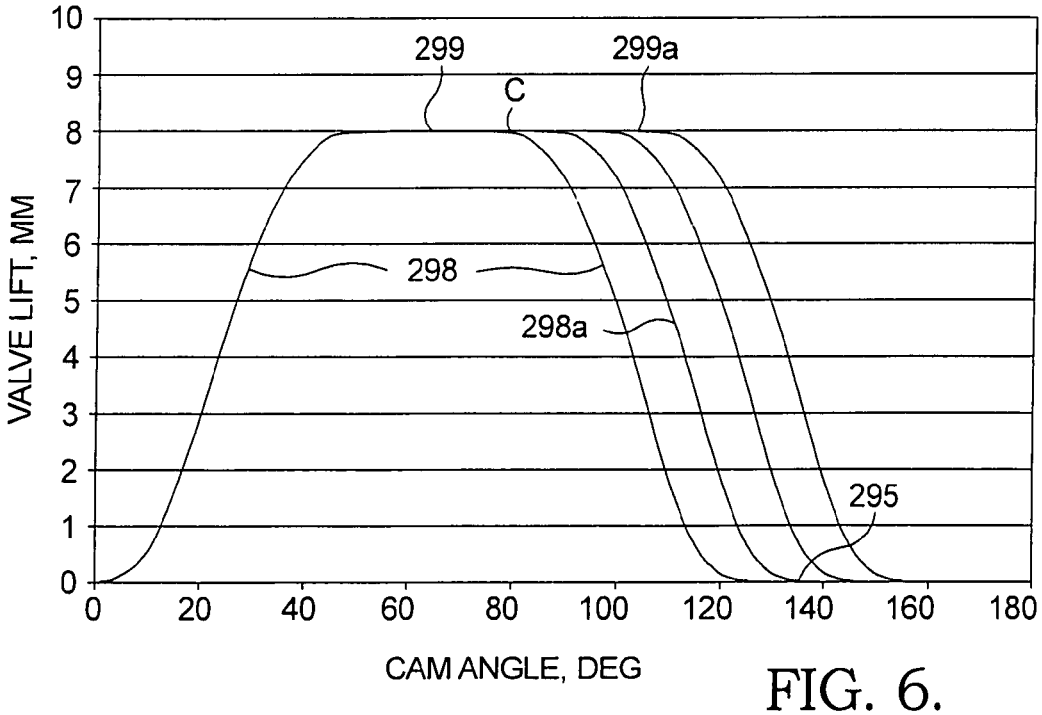
FIG. 6 is a family of lift curves for a valvetrain equipped with the cam lobe shown in FIG. 5.

Referring to FIGS. 5 and 6, second embodiment 200 in accordance with the invention is identical to CVVD system 100, having the same components as shown in FIGS. 1, 1*a*, 2, and 2*a* except for revised opening/closing cam lobes 208,234. Embodiment 200 reduces or eliminates the velocity of the intake valve 188 at the transition point (point A in FIG. 3) between the opening cam lobe 108 and roller 172 and the closing cam lobe 134 and roller 174 by changing the contours of nose portions 216,242 to produce flat portions 299,299*a* of family curves 298,298*a* at peak valve lift. Thus, the transition point C in FIG. 6, at which closing cam lobe 234 takes control of rocker sub assembly 160 from opening cam lobe 208, occurs when the oscillating components of CVVD 200 are near or at zero velocity. Note that the extended point 295 of intake valve closing of CVVD 200 approximately 140 cam angle degrees), as shown in FIG. 6, is identical to the extended point 195 of intake valve closing of CVVD 100 (approximately 140 cam angle degrees), as shown in FIG. 3.

Figure 7A:
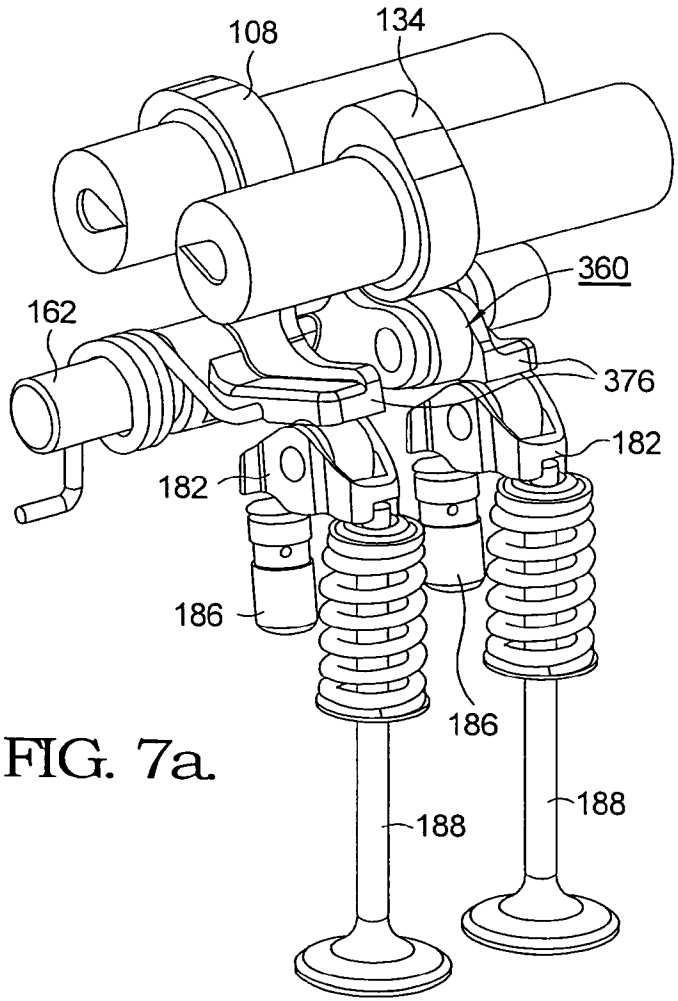
FIGS. 7 and 7*a* are end elevation and isometric views, respectively, of a third, embodiment of a CVVD system in accordance with the invention.
Figure 7:
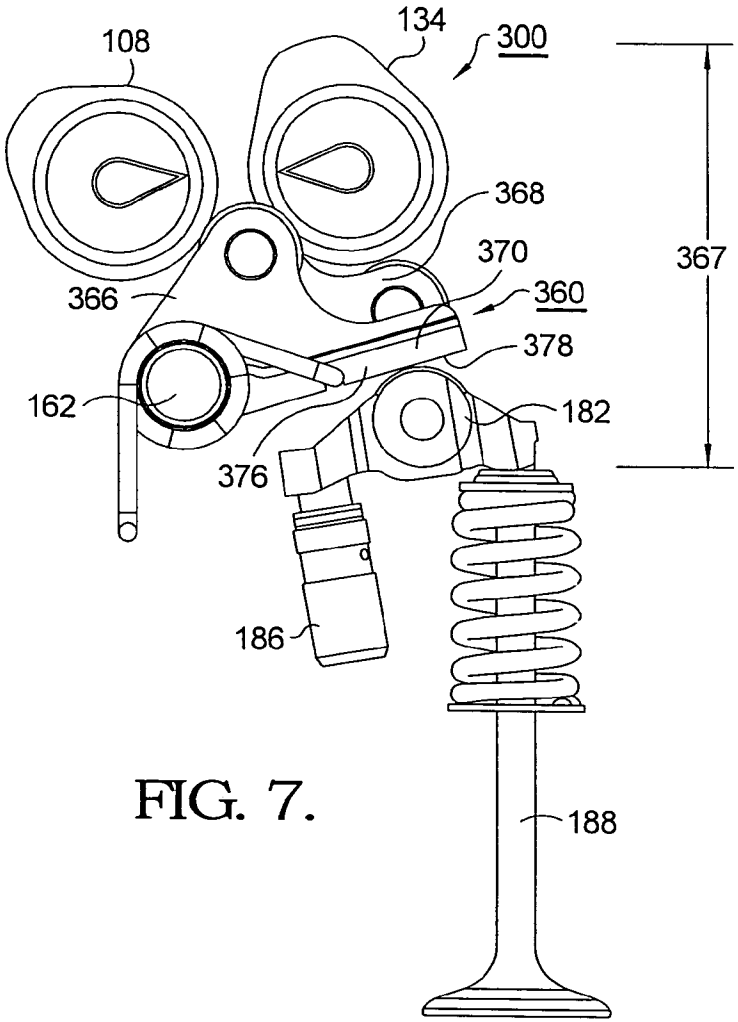

Referring to FIGS. 7 and 7*a*, a third embodiment 300 of a CVVD in accordance with the invention is shown. CVVD 300 is similar to CVVD 100 in that second rocker subassembly 360 acts upon roller finger follower 182 that pivots on a hydraulic lash adjuster 186 to provide a downward force on valve 188 to move valve 188 in an opening direction. Rocker assembly 360 includes an opening input arm 366, a closing input arm 368 and an output arm 370; however, rocker assembly 360 is more compact than rocker assembly 160, thus lowering the packaging height 367 over that of CVVD 100. Also, paddle 376 and its contact surface 378 are generally flat, greatly reducing the cost of manufacture.

Figure 8A:
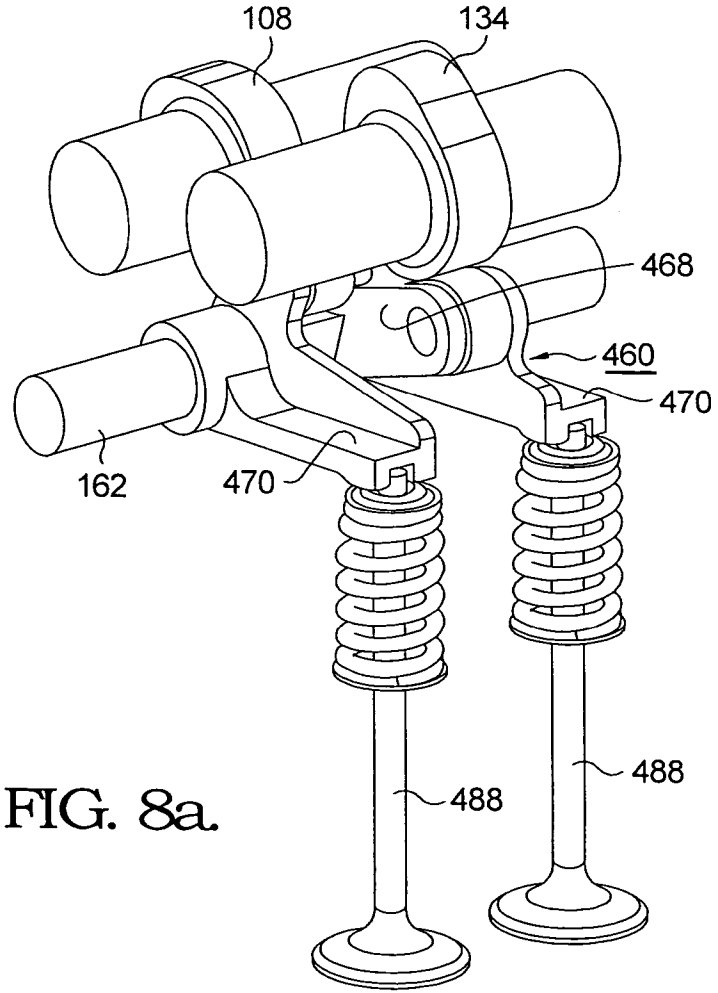
FIGS. 8 and 8*a* are end elevation and isometric views, respectively, of a fourth embodiment of a CVVD system in accordance with the invention.
Figure 8:
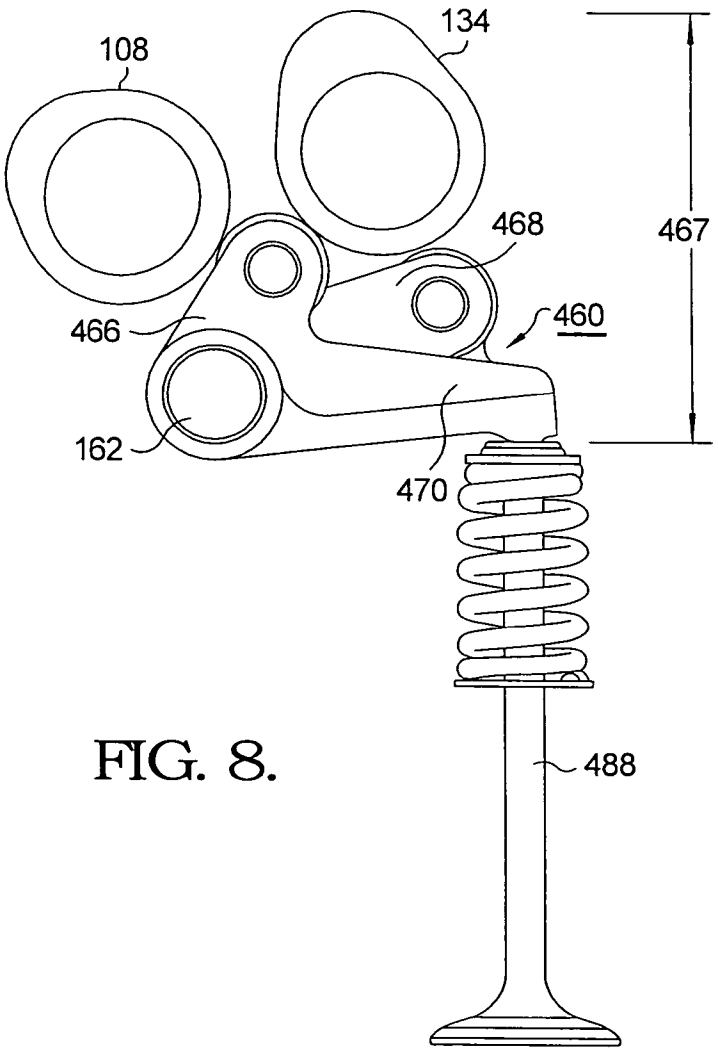

Referring now to FIGS. 8 and 8*a*, a fourth embodiment 400 of a CVVD in accordance with the invention is also a variation of CVVD 100. Like CVVD 300, CVVD 400 is a more compact design thereby lowering the package height 467 over CVVD 100 and CVVD 300. Rocker assembly 460 includes an opening input arm 466, a closing input arm 468, and output arm 470. CVVD 400 is adaptable to a Type 2 (end pivot rocker arm, overhead cam) valve train system, in that output arm 470 engages the stem of valve 488 directly; thus, the hydraulic lash adjuster 186 and roller finger follower 182 required for embodiments 100,300 are obviated, thereby simplifying the mechanism even more.

While the invention has been described as applicable to intake valves, it is understood that the invention's application need not be so limited.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A valve actuation system for controllably varying angular duration of an opening event of a combustion valve in an internal combustion engine with respect to rotation of an engine crankshaft, comprising:

a) a rocker assembly pivotably disposed on a pivot shaft for opening and closing said valve, said pivot shaft having an axis of rotation in a fixed position relative to said engine;

b) a first cam lobe disposed on an opening camshaft driven by said crankshaft of said engine and engaging said rocker assembly for controlling at least said opening event of said valve, said first cam lobe including a first nose portion configured to produce zero acceleration of said valve at maximum valve lift; and c) a second cam lobe disposed on a closing camshaft operationally connected to said opening camshaft via a cam phaser and selectively engaging said rocker assembly for variably controlling a closing event of said valve, said second cam lobe including a second nose portion configured to produce zero acceleration of said valve at maximum valve lift, wherein a shift in phase between said first cam lobe and said second cam lobe effected by said cam phaser on said closing camshaft changes a closing point of said valve, and wherein a transition point at which said second cam lobe takes control of said rocker assembly from said first cam lobe occurs when said first nose portion and said second nose portion are in contact with said rocker assembly.

2. A system in accordance with claim 1 wherein said selectively engaging includes not engaging said rocker assembly during engine operation.

3. A system in accordance with claim 1 wherein said rocker assembly comprises an opening arm for engaging said first cam lobe, a closing arm for engaging said second cam lobe, and an output arm.

4. A system in accordance with claim 1 further comprising a return spring operationally disposed between said rocker assembly and said engine.

5. A system in accordance with claim 1 wherein said valve is selected from the group consisting of intake valve and exhaust valve.

6. A system in accordance with claim 1 wherein said rocker assembly engages said valve directly.

7. A system in accordance with claim 1 wherein said rocker assembly engages said valve via a rocker arm disposed therebetween and pivotably mounted on said engine.

8. A system in accordance with claim 1 wherein said opening camshaft and said closing camshaft are operationally connected via a gear train.

9. A system in accordance with claim 1 for operating a bank of valves in said internal combustion engine, further comprising:

a) a plurality of said first cam lobe spaced apart along said opening camshaft, one for each of said valves;

b) a plurality of said second cam lobe spaced apart along said closing camshaft, one for each of said valves; and c) a plurality of said rocker assembly spaced apart along said pivot shaft, one for each of said valves, wherein a shift in phasing between said opening camshaft and said closing camshaft effected by said cam phaser on said closing camshaft changes the closing point of said bank of valves.

10. A system in accordance with claim 1 wherein said rocker assembly is in direct contact with at least an ascending flank of said first cam lobe for controlling said at least an opening event of the valve.

11. A system in accordance with claim 1 wherein said rocker assembly is disposed above said combustion valve.

12. A system in accordance with claim 1 wherein said first nose portion is configured to produce zero velocity at maximum valve lift, and wherein said second nose portion is configured to produce zero velocity of said valve at maximum valve lift.

13. A system in accordance with claim 3 wherein a distal end of said output arm includes an actuating paddle having a progressively increasing radius as measured from said pivot shaft axis of rotation.

14. A system in accordance with claim 4 wherein said return spring includes a first end and a second end and wherein said first end is connected to said rocker assembly and said second end is connected to said internal combustion engine.

15. An internal combustion engine, comprising a valve actuation system for controllably varying angular duration of an opening event of a combustion valve in said engine with respect to rotation of an engine crankshaft, including a rocker assembly pivotably disposed on a pivot shaft for opening and closing said valve, said pivot shaft having an axis of rotation in a fixed position relative to said engine, a first cam lobe disposed on an opening camshaft driven by said crankshaft of said engine and engaging said rocker assembly for controlling at least said opening event of said valve, said first cam lobe including a first nose portion configured to produce zero acceleration of said valve at maximum valve lift, and a second cam lobe disposed on a closing camshaft operationally connected to said opening camshaft via a cam phaser and selectively engaging said rocker assembly for variably controlling a closing event of said valve, said second cam lobe including a second nose portion configured to produce zero acceleration of said valve at maximum valve lift, wherein a shift in phase between said first cam lobe and said second cam lobe effected by said cam phaser on said closing camshaft changes a closing point of said valve, and wherein a transition point at which said second cam lobe takes control of said rocker assembly from said first cam lobe occurs when said first nose portion and said second nose portion are in contact with said rocker assembly.

16. An engine in accordance with claim 15 wherein said valve actuation system further comprises a rocker arm pivotably disposed between said rocker assembly and said valve.

17. An engine in accordance with claim 15 wherein said rocker assembly is in direct contact with at least an ascending flank of said first cam lobe for controlling said at least an opening event of said valve.

18. An engine in accordance with claim 15 wherein said first nose portion is configured to produce zero velocity at maximum valve lift, and wherein said second nose portion is configured to produce zero velocity of said valve at maximum valve lift.

* * * * *